US011703250B1

(12) United States Patent
Mosiman et al.

(10) Patent No.: US 11,703,250 B1
(45) Date of Patent: Jul. 18, 2023

(54) AIR DEFLECTOR SYSTEM

(71) Applicant: Spectrum Products LLC, Mesa, AZ (US)

(72) Inventors: Renee Mosiman, Mesa, AZ (US); Michael Mosiman, Mesa, AZ (US)

(73) Assignee: Spectrum Products, LLC, Mesa, AZ (US)

( * ) Notice: Subject to any disclaimer, the term of this patent is extended or adjusted under 35 U.S.C. 154(b) by 0 days.

(21) Appl. No.: 17/196,407

(22) Filed: Mar. 9, 2021

(51) Int. Cl.
*F24F 13/14* (2006.01)

(52) U.S. Cl.
CPC .... *F24F 13/1426* (2013.01); *F24F 2013/148* (2013.01)

(58) Field of Classification Search
CPC ..... F24F 13/06; F24F 13/08; F24F 13/084; F24F 13/12; F24F 13/1426; F24F 2221/14–17; F24F 2013/148; H01F 7/0252; E05C 19/16
See application file for complete search history.

(56) References Cited

U.S. PATENT DOCUMENTS 3,225,679 A * 12/1965 Meyer ..... F24F 13/08 454/307
3,358,578 A * 12/1967 Meyer ..... F24F 13/08 454/307
3,768,235 A * 10/1973 Meyer ..... B01D 46/12 160/228
D281,999 S * 12/1985 Shames ..... D23/391
6,929,542 B1 * 8/2005 Stravitz ..... F24F 13/06 454/307

FOREIGN PATENT DOCUMENTS

KR 20180087628 A * 8/2018

OTHER PUBLICATIONS

China Magnets Source Material Limited, Custom Stepped Neodymium Magnets Manufacturer | China Magnets Source Material Limited, Aug. 11, 2020, Description and timestamp 0:05, https://www.youtube.com/watch?v=3CKWJ7p8gDU (Year: 2020).*
Chinamagnetssource, Custom Stepped Magnets, Sep. 22, 2020, Stepped Magnets Specifications and figure under that section https://sourcemagnets.com/products/china-custom-stepped-magnets-manufacturer/ (Year: 2020).*

* cited by examiner

*Primary Examiner* — Edelmira Bosques
*Assistant Examiner* — Michael James Giordano
(74) *Attorney, Agent, or Firm* — IPTechLaw

(57) ABSTRACT

Implementations of air deflectors may include a curved section coupled between a first and second sidewall. Air deflectors may also include a first magnet retainer extending from the first sidewall. The first magnet retainer may include a first retainer wall, a second retainer wall, and a retainer tab extending from the first sidewall and positioned between the first retainer wall and the second retainer wall. A first magnet may be positioned between the first retainer wall and the second retainer wall. The air deflector may also include a second magnet retainer extending from the second sidewall and a second magnet coupled with the second magnet retainer. The first retainer wall and the second retainer wall may each include a ledge directly coupled to the first magnet. The first magnet may be coupled between the retainer tab and each ledge of the first retainer wall and the second retainer wall.

19 Claims, 7 Drawing Sheets

AIR DEFLECTOR SYSTEM

BACKGROUND

1. Technical Field

Aspects of this document relate generally to ventilation accessories, such as vent covers for directing the flow of air from the vent. More specific implementations involve vent covers having magnetic fasteners.

2. Background

Vent deflectors, referred to herein as air deflectors, are placed over a vent and redirect the flow of air coming from the vent. The redirection of air from the vent may enhance the efficiency of heating or cooling a particular space inasmuch as it will direct the heated or cooled air towards the center of a roof and away from the wall.

SUMMARY

Implementations of air deflectors may include a curved section coupled between a first sidewall and a second sidewall. Air deflectors may also include a first magnet retainer extending from the first sidewall. The first magnet retainer may include a first retainer wall, a second retainer wall, and a retainer tab extending from the first sidewall and positioned between the first retainer wall and the second retainer wall. A first magnet may be positioned between the first retainer wall and the second retainer wall. The air deflector may also include a second magnet retainer extending from the second sidewall and a second magnet coupled with the second magnet retainer. The first retainer wall and the second retainer wall may each include a ledge directly coupled to the first magnet. The first magnet may be coupled between the retainer tab and each ledge of the first retainer wall and the second retainer wall.

Implementations of air deflectors may include one, all, or any of the following:

A largest planar surface of the first magnet may be perpendicular to a largest planar surface of the first sidewall and second sidewall.

The first magnet and second magnet may be neodymium magnets.

Implementations of the air deflector may further include a notch located in the first sidewall and below a portion of the first sidewall from which the retainer tab extends.

The first retainer wall and the second retainer wall may include a chamfer.

An end of the retainer tab may be coupled over a first side of the first magnet opposite a second side of the first magnet facing the first sidewall.

The magnet retainer may be configured to expose the magnet between each ledge of the first retainer wall and the second retainer wall.

The first magnet may include a first ridge and a second ridge.

The magnet may be configured to contact a vent grille.

Implementations of air deflectors may include a first portion that includes a sidewall. A first magnet retainer may be coupled to the sidewall of the first portion. The first magnet retainer may include a first retainer wall and a second retainer wall. The first retainer wall may include a first ledge configured to secure a magnet. The second retainer wall may include a second ledge configured to secure the magnet. The first magnet retainer may include a retainer tab extending from the sidewall of the first portion and positioned between the first retainer wall and the second retainer wall. Air deflectors may also include a second portion including a sidewall and a plurality of guides configured to slidably couple the first portion to the second portion. Air deflectors may also include a second magnet retainer coupled to the sidewall of the second portion. The second magnet retainer may be structurally the same as the first magnet retainer. The first magnet retainer may be configured to retain a magnet between the retainer tab and the first ledge and second ledge.

Implementations of air deflectors may include one, all, or any of the following:

The first magnet retainer may be configured to retain the magnet in a position where the magnet has a largest planar surface of the magnet perpendicular to a largest planar surface of the sidewall of the first portion.

The first magnet retainer may be configured to retain the magnet between the first ledge and the second ledge.

The first magnet retainer may be configured to allow the magnet to contact a vent grille.

The plurality of guides may include a first guide coupled to a first side of a curved portion of the second portion and extending substantially across a length of the first side of the curved portion.

The plurality of guides may include a second guide coupled to a second side of the curved portion of the second portion, the second side opposite the first side, and a third guide coupled to the second side of the curved portion of the second portion.

Implementations of air deflectors may include a first portion including a sidewall and a first magnet retainer coupled to the sidewall of the first portion. The first magnet retainer may include a first retainer wall, a second retainer sidewall, and a retainer tab extending from the sidewall of the first portion and positioned between the first retainer wall and the second retainer wall. The first retainer wall may include a first ledge configured to secure a magnet. The second retainer wall may include a second ledge configured to secure the magnet. Implementations of the air deflector may also include a second portion including a sidewall and a second magnet retainer coupled to the sidewall of the second portion. The second magnet retainer may be structurally the same as the first magnet retainer. The first portion may be slidably coupled to the second portion through a plurality of guides included in the second portion. The first portion may include a stop tab configured to prevent the first portion from separating from the second portion. The first magnet retainer may be configured to retain a magnet between the retainer tab and the first ledge and second ledge.

Implementations of air deflectors may include one, all, or any of the following:

The first retainer wall and the second retainer wall include a chamfer.

An end of the retainer tab may be configured to couple over a side of the magnet opposite the side of the magnet facing the sidewall of the first portion.

The first magnet retainer may be configured to retain the magnet between the first ledge and the second ledge.

The stop tab may be configured to contact a guide of the plurality of guides.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components, assembly procedures or method elements disclosed herein. Many additional components, assembly procedures and/or method elements known in the art consistent with the intended air deflectors will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such air deflectors, and implementing components and methods, consistent with the intended operation and methods.

Figure 1:
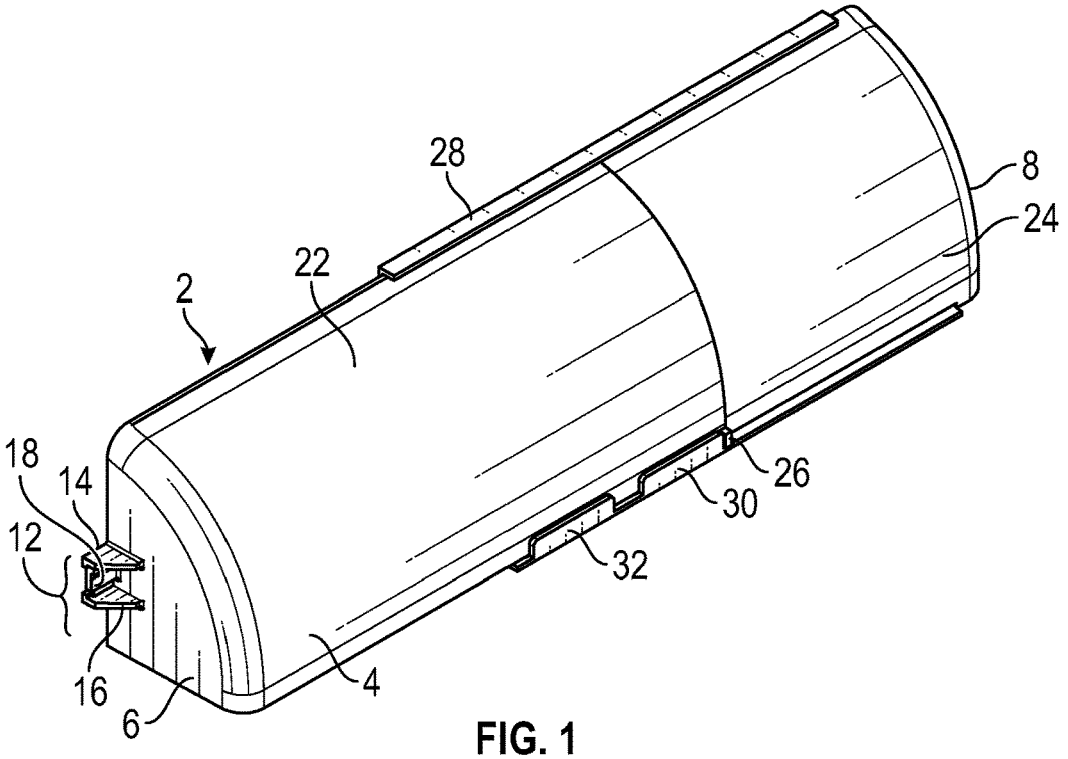
FIG. 1 is a back perspective view of an implementation of an air deflector.

Referring to FIG. 1, an implementation of an air deflector 2 is illustrated. In various implementations, the air deflectors disclosed herein may be formed of plastic. In such implementations, the plastic may be transparent, translucent, or opaque. In other implementations, the air deflectors may be formed from metal, glass, or any other type of polymer.

In various implementations, the air deflector may include a first portion 22 and a second portion 24, as is illustrated by FIG. 1. In such implementations, the air deflector may include two separate portions configured to provide the air deflector with an adjustable length. In other implementations, the air deflector may be formed as a single piece rather than having two separable portions. In such implementations, the air deflector does not have an adjustable length. In such implementations, the length of the air deflector may correspond to the length of a vent grille.

As illustrated by FIG. 1, the air deflector includes a curved section 4 coupled between a first sidewall 6 and a second sidewall 8. In other implementations, rather than the curved section, the air deflector may include a flat midsection coupled between the first sidewall and the second sidewall (which would result in the first and second sidewalls being triangles). In still other implementations, the midsection may include multiple flat sections, resulting in the sidewalls forming quadrilaterals, pentagons, hexagons, or any other shape having any other number of sides. In various implementations, the first sidewall 6 may be part of the first portion 22 and the second sidewall 8 may be part of the second portion. In other implementations, a single portion may include the first sidewall 6 and the second sidewall 8.

Figure 2:
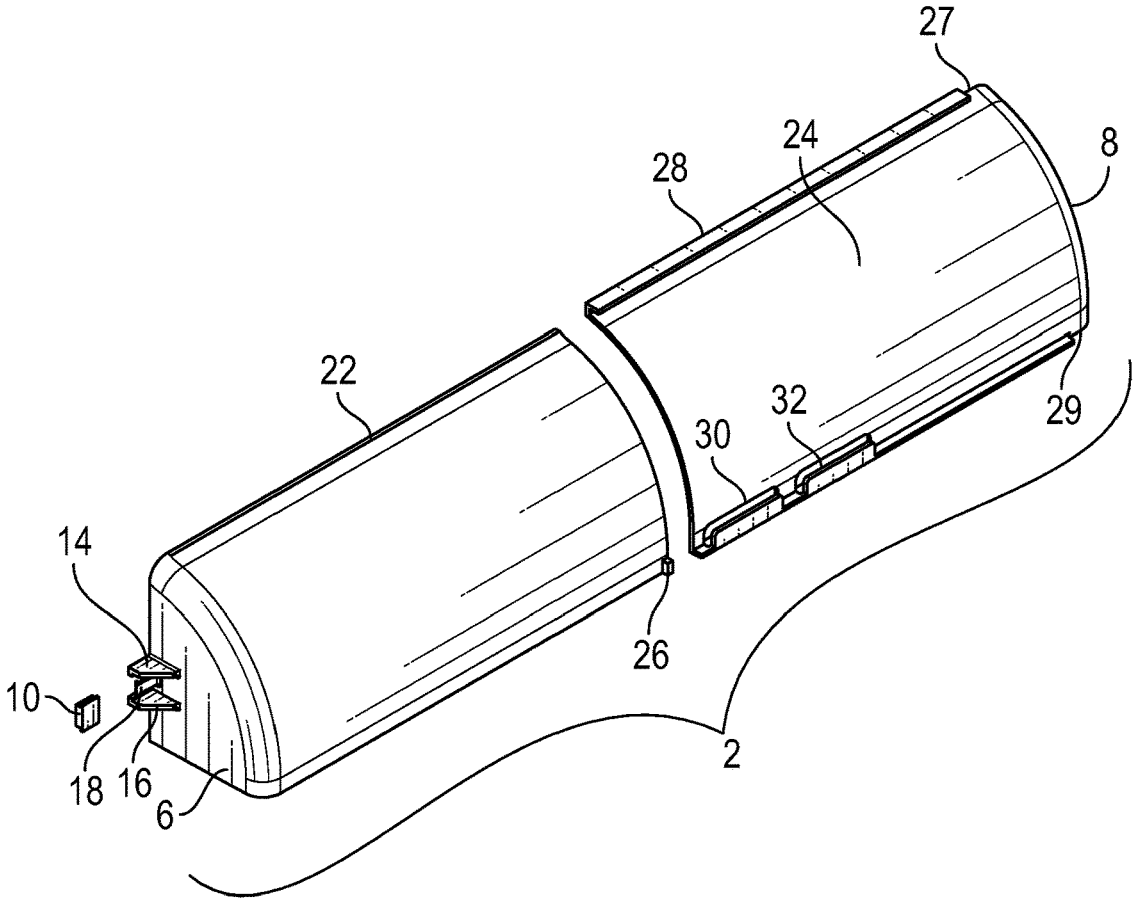
FIG. 2 is a break apart view of the air deflector of FIG. 1.
Figure 15:
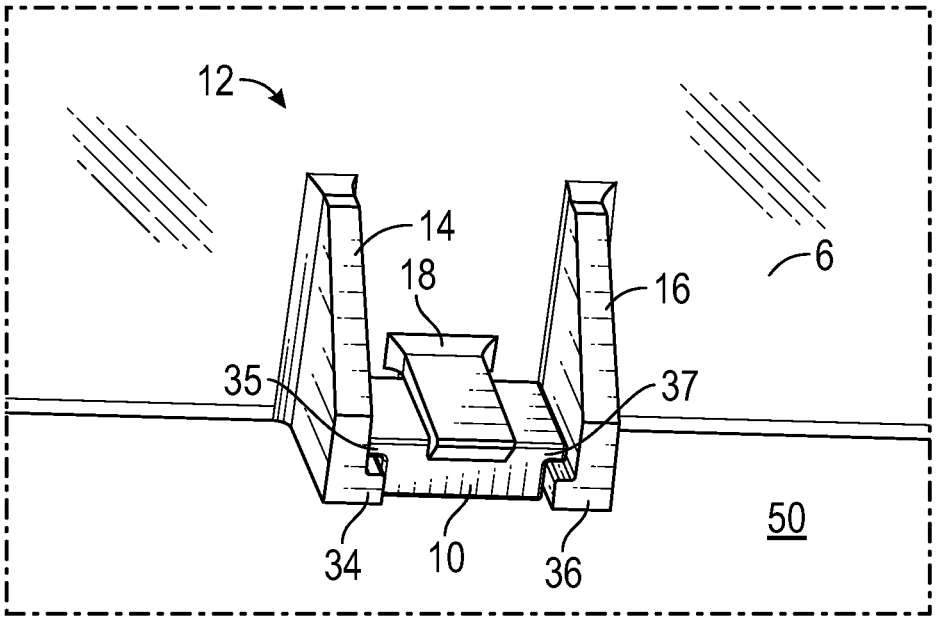
FIG. 15 is a magnified perspective view of the magnet retainer of FIG. 1.

Still referring to FIG. 1, the air deflector includes a first magnet retainer 12 extending from the first sidewall 6. Referring to FIG. 15, a magnified view of the first magnet retainer 12 is illustrated. The first magnet retainer 12 includes a first retainer wall 14, a second retainer wall 16, and a retainer tab 18. The first magnet retainer 12 is configured to receive and hold a magnet. In this particular view, a first magnet 10 is positioned between the first retainer wall 14 and the second retainer wall 16. In various implementations, a largest surface of the first magnet is perpendicular to a largest surface of the first sidewall and second sidewall when the magnet is held by the magnet retainer. In various implementations, the first magnet, and any other magnet disclosed herein, may be a neodymium magnet. In other implementations, the first magnet and/or any other magnet disclosed herein may be another type of magnet. In FIG. 2, the first magnet is illustrated as removed from the first magnet retainer 12.

Figure 9:
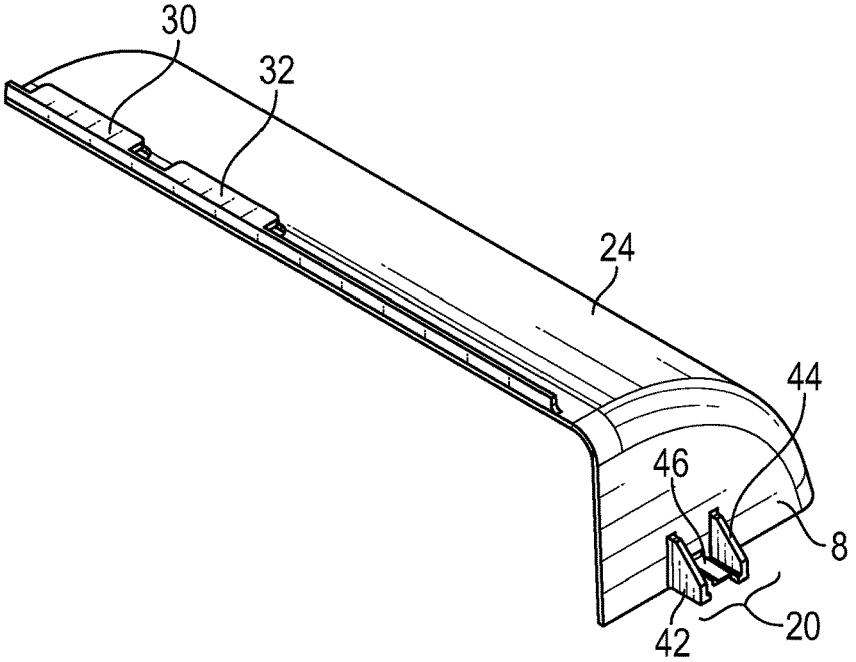
FIG. 9 is an upper perspective view of a second portion of the air deflector of FIG. 1.
Figure 10:
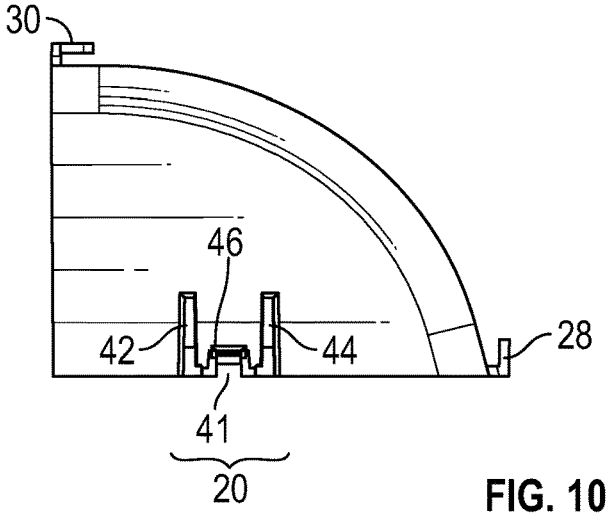
FIG. 10 is an outside side view of a second portion of the air deflector of FIG. 1.

Though not illustrated by FIG. 1, in various implementations the air deflector 2 includes a second magnet retainer extending from the second sidewall 8. The second magnet retainer 20 is illustrated in FIGS. 9-10. In various implementations, a second magnet may be coupled within the second magnet retainer. In various implementations, the second magnet retainer may have the same structure as the first magnet retainer. In other implementations, the second magnet retainer may have a structure that is different from the first magnet retainer.

While the implementations of air deflectors disclosed herein include two separate magnet retainers, it is understood that in other implementations the air deflector may include only a single magnet retainer, three magnet retainers, four magnet retainers, or more than four magnet retainers. Further, while the implementations disclosed herein include the magnet retainers directly coupled to the sidewalls, in other implementations an air deflector may include a magnet retainer coupled to the backside of the curved section 4 and configured to secure a magnet which in turn secures the air deflector to a vent grille through a magnetic force. Further, while the implementations disclosed herein include the magnet retainers as extending away from the air deflector, in other implementations the magnet retainers may be directly coupled to an inner surface of the sidewalls and may extend towards a center of the air deflector.

Referring to FIG. 2, a break apart view of the air deflector of FIG. 1 is illustrated. In various implementations the air deflector includes a first portion 22 and a second portion 24. As illustrated, the first portion 22 includes a sidewall 6. A first magnet retainer 12 is coupled to the first sidewall 6. The first magnet retainer 12 includes a first retainer wall 14, a second retainer wall 16, and a retainer tab 18.

In various implementations, the second portion 24 includes a sidewall 8 and a plurality of guides configured to slidably couple the first portion to the second portion. As illustrated, the plurality of guides includes a first guide 28 coupled to a first side 27 of a curved portion of the second portion 24 and extending substantially across a length of the first side of the curved portion. A second guide 30 may also be coupled to a second side 29 of the curved portion of the second portion 24, the second side 29 opposite the first side 27. In various implementations, a third guide 32 is coupled to the second side 29 of the curved portion of the second portion. While the implementations disclosed herein discuss the plurality of guides having three separate guides, in other implementations the plurality of guides may include only one guide, two guides, or more than three guides. In various implementations, one or more edges of the first portion may be configured to slide under the plurality of guides.

Though not illustrated, in various implementations the air deflector may include a locking mechanism configured to fix the first portion of the air deflector to the second portion of the air deflector. In such implementations the locking mechanism may include, among other things, a clamp which secures an edge of the first portion to an edge of the second portion.

Figure 3:
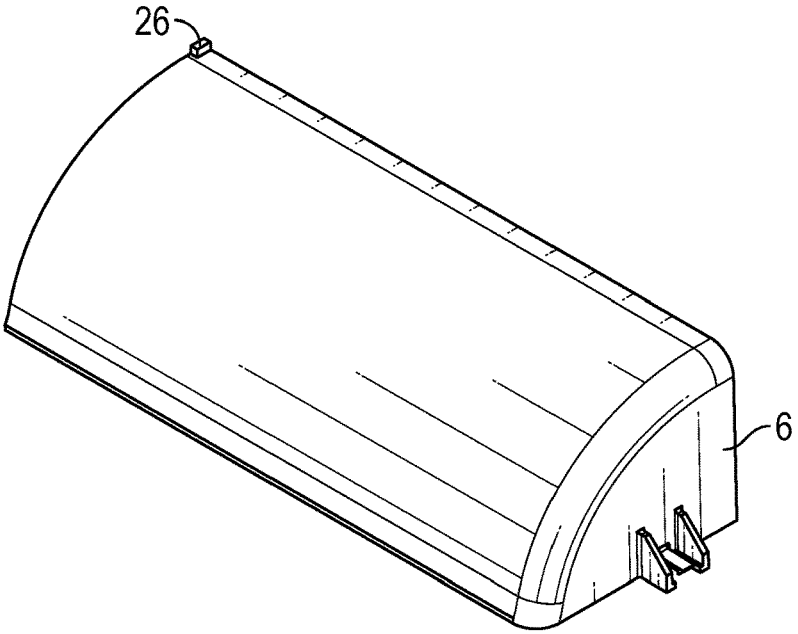
FIG. 3 is a perspective right side view of a first portion of air deflector of FIG. 1.

Referring to FIG. 3, a right view of the first portion 22 of the air deflector of FIG. 1 is illustrated. As illustrated, the first portion includes a sidewall 8 and a curved portion. In various implementations the first portion may also include a stop tab 26. The stop tab 26 is configured to contact a guide of the plurality of guides as illustrated in FIG. 1. In such implementations, the stop tab may prevent the first portion from being separated from the second portion. In various implementations, the stop tab may limit the adjustability of the length of the air deflector to a set range. In other implementations, the air deflector does not include a stop tab configured to contact a guide rail.

Figure 4:
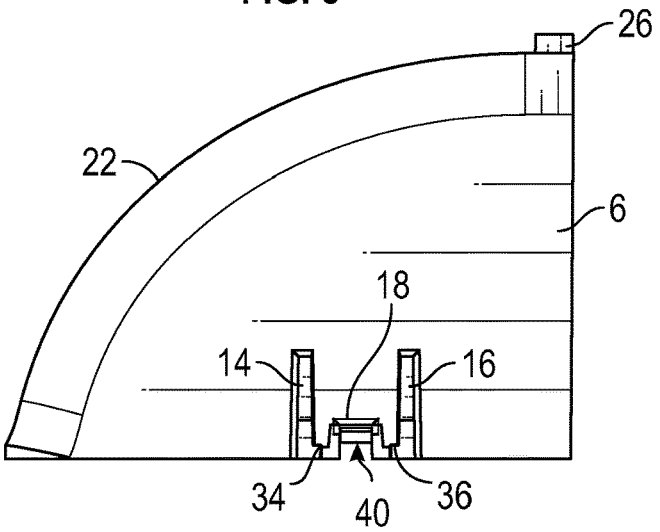
FIG. 4 is a side view of a first portion of the air deflector of FIG. 1.
Figure 14:
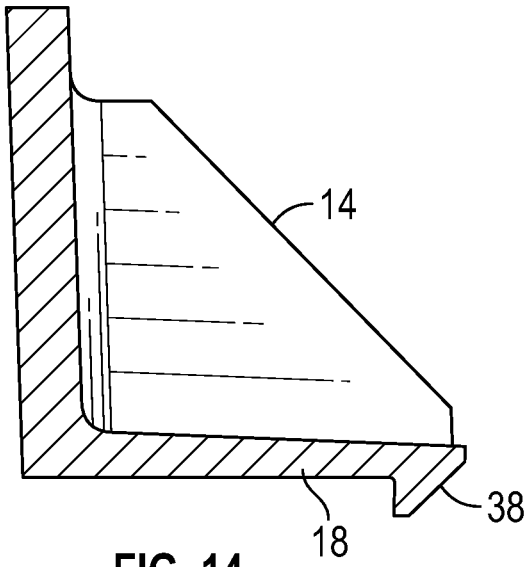
FIG. 14 is a cross sectional view of an implementation of a retainer tab of an air deflector.

Referring to FIG. 4, a side view of a first portion 22 of the air deflector of FIG. 1 is illustrated. As illustrated by FIG. 4, in various implementations the first retainer wall 14 may include a first ledge 34. The first ledge 34 is configured to secure a magnet. In various implementations, the second retainer wall 16 may include a second ledge 36 configured to secure a magnet. Here, a retainer tab 18 extending from the sidewall of the first portion and positioned between the retainer wall and the second retainer wall is illustrated. In various implementations, an end 38 of the retainer tab is configured to couple over a side of the magnet opposite the side of the magnet facing the sidewall 6 of the first portion 22. Referring to FIG. 14, a magnified view of the retainer tab 18 and the end 38 of the retainer tab are illustrated in FIG. 14. In implementations having the end 38 of the retainer tab which couples over an edge of the magnet, the end of the retainer tab may prevent the magnet from inadvertently sliding out from the magnet retainer. Further, the first ledge 34, the second ledge 36, and the portion of the retainer tab contacting the largest surface of the magnet may prevent the magnet from inadvertently falling or being removed from the magnet retainer. In such implementations, the end 38 of the retainer tab 18, the retainer tab 18, the first ledge 34, the second ledge 36, the first retainer wall 14, and the second retainer wall 16 may all work together to secure a magnet within the magnet retainer.

In various implementations, the magnet received by the first magnet retainer may include a portion configured to be received between the first ledge 34 and the second ledge 36. In such implementations, the magnet may be configured to contact a vent grille inasmuch as a bottom surface of the magnet may be flush with a bottom of the air deflector. In other implementations, the magnet may not be configured to contact the vent grille but the magnet may still secure the air deflector to the vent grille through the magnetic force between the magnet and the vent grille.

Figure 5:
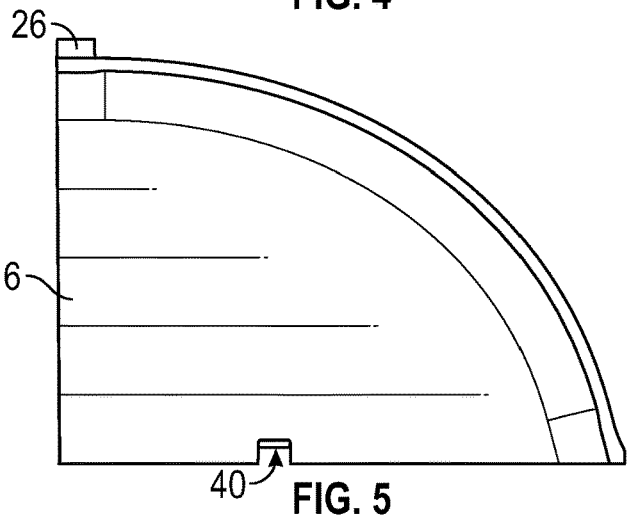
FIG. 5. is an inner side view of a first portion of the air deflector of FIG. 1.

Referring back to FIG. 4, in various implementations the air deflector includes a notch 40 located in the first sidewall 6. The notch 40 may be below a portion of the first sidewall from which the retainer tab 18 extends. An inner side view of air deflector illustrating the notch 40 is illustrated in FIG. 5. In various implementations, the air deflector may also include a second notch below a portion of the second sidewall from which a second retainer tab of a second magnet retainer extends. In other implementations, the air deflector may not include notch 40.

Figure 6:
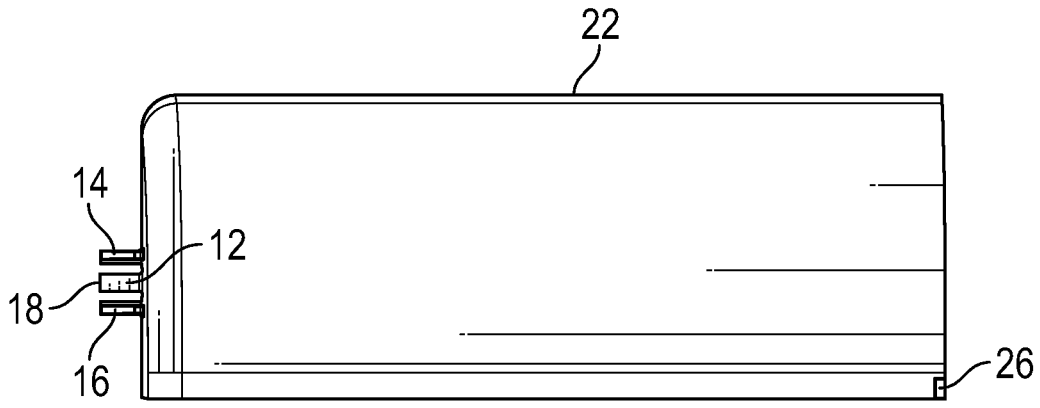
FIG. 6 is a top view of a first portion of the air deflector of FIG. 1.
Figure 7:
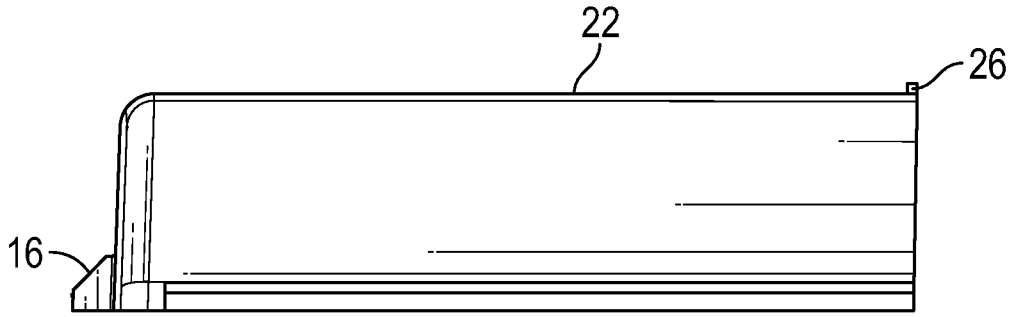
FIG. 7 is an front view of a first portion of the air deflector of FIG. 1.
Figure 8:
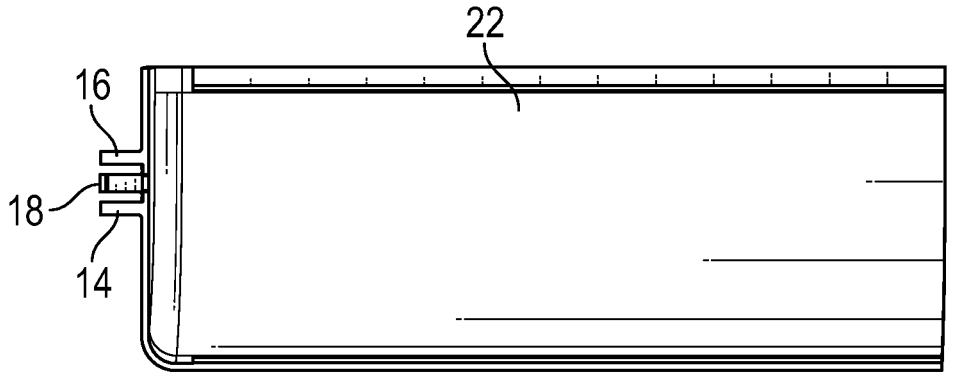
FIG. 8 is a bottom view of a first portion of the air deflector of FIG. 1.

Referring to FIGS. 6-8, various views of a first portion 22 of the air deflector of FIG. 1 is illustrated. In FIG. 6, a top outer view of the first portion is illustrated. In this view the first retainer wall 14 and the second retainer wall 16 of the first magnet retainer 12 are illustrated. The retainer tab 18 is illustrated extending from the sidewall of the first portion and positioned between the first retainer wall 14 and the second retainer wall 16. Referring to FIG. 7, a front view of a first portion of an implementation of an air deflector is illustrated. In this view, the second retainer wall of the first magnet retainer is illustrated. In various implementations, the retainer walls may include chamfers. In sum implementations, the retainer wall may have a perimeter having a substantially triangular shape. In other implementations the perimeter of the retainer walls may include any other type of shape, including, by non-limiting example, a rectangular or any other type of shape. Referring to FIG. 8, a bottom view of a first portion of an implementation of an air deflector is illustrated. The end 38 of the retainer tab 18 is illustrated in FIG. 8.

Figure 11:
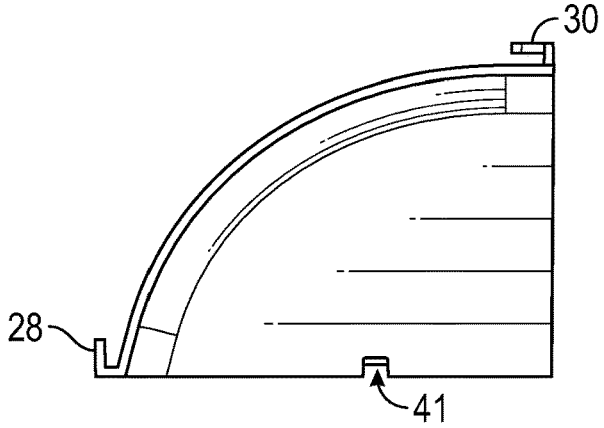
FIG. 11 is an inside side view of a second portion of the air deflector of FIG. 1.

Referring to FIGS. 9-11, various views of the second portion of the air deflector of FIG. 1 is illustrated. Referring specifically to FIG. 9, a perspective view of the second portion is illustrated. In this view, a second magnet retainer 20 is illustrated. The second magnet retainer is coupled to the sidewall 8 of the second portion 24. In various implementations, the second magnet retainer may be structurally the same as the first magnet retainer having a first retainer wall 42, a second retainer wall 44, and a retainer tab 46. The retainer tab 46 is illustrated extending from the sidewall portion 8 of the second portion 24 and is positioned between the first retainer wall 42 and the second retainer wall 44. In this view, the second guide 30 and third guide 32 coupled to the second portion are illustrated. As previously described, the plurality of guides on the second portion are configured to receive the first portion 22 to enable the first portion 22 to slidably couple with the second portion 24.

Referring to FIG. 10, an outer side view of the second portion of the air deflector of FIG. 1 is illustrated. In this view, the second magnet retainer 20 is illustrated and the ledges of each retainer wall are visible. The ledges are configured to retain a magnet between the ledges and the retainer tab. In various implementations, the magnet received by the magnet retainer may include a portion configured to be received between the two ledges. In such implementations, the magnet may be configured to contact a vent grille inasmuch as a bottom surface of the magnet may be flush with a bottom of the air deflector. In other implementations, the magnet may not be configured to contact the vent grille but the magnet may still secure the air deflector to the vent grille through the magnetic force between the magnet and the vent grille.

Still referring to FIG. 10, the first guide 28 and the second guide 30 of the second portion 24 are illustrated. Referring to FIG. 11, an inner view of the second portion of the air deflector of FIG. 1 is illustrated. In various implementations, the air deflector may include a notch 41 in the second sidewall 8 as illustrated. As previously described, the notch 41 may be located in the second sidewall 8 and below a portion of the second sidewall from which the retainer tab of the magnet retainer 20 extends. In other implementations, the air deflector may not include notch 41.

Figure 12:
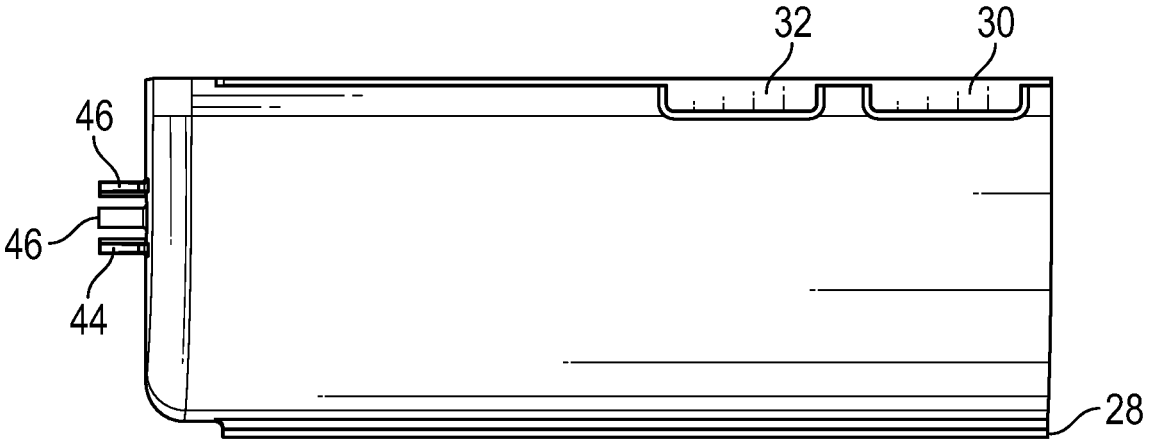
FIG. 12 is a top view of a second portion of the air deflector of FIG. 1.
Figure 13:
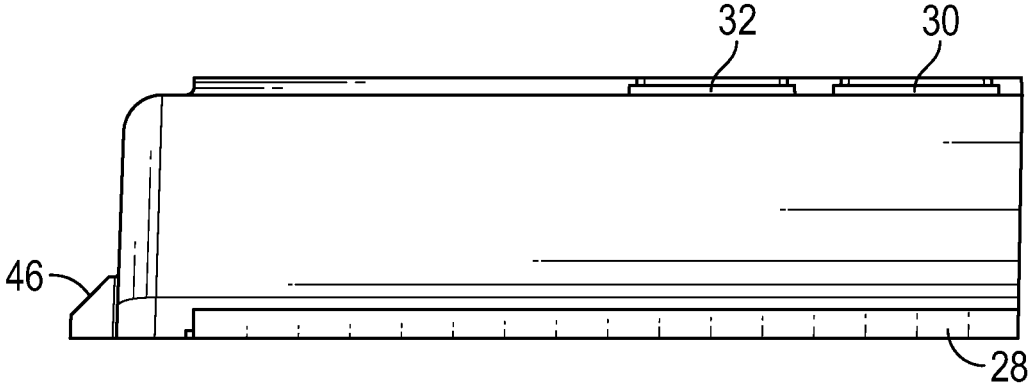
FIG. 13 is an outside rear view of a second portion of the air deflector of FIG. 1.

Referring to FIG. 12, a top view of the second portion of the air deflector of FIG. 1 is illustrated. In this view, the first guide 28, second guide 30, and third guide 32 of the second portion are illustrated. The first retainer wall 42, second retainer wall 44, and retainer tab 46 of the second magnet retainer are also illustrated. Referring to FIG. 13, an outer rear view of the second portion of the implementation of the air deflector is illustrated. In various implementations, and as illustrated by FIG. 13, the second retainer wall and/or the first retainer wall of the magnet retainer may each include a chamfer. In such implementations, the second retainer wall and/or the first retainer wall may include a perimeter having a substantially triangular shape.

Referring to FIG. 15, a close up view of an implementation of the first magnet retainer is illustrated. As illustrated by FIG. 15, in various implementations the first magnet retainer 12 includes a first retainer wall 14 having a first ledge 34 configured to secure a magnet 10. The first magnet retainer also has a second retainer wall 16 having a ledge 36 configured to secure a magnet 10. The retainer tab may be positioned between the first retainer wall and the second retainer wall. In various implementations, and as illustrated, the magnet retainer 12 is configured to expose the magnet 10 between ledge 34 and ledge 36. As illustrated by FIG. 15, a largest surface of the first magnet 10 is perpendicular to a largest surface of the first sidewall 6 and second sidewall (not shown in FIG. 15).

In various implementations, and as illustrated by FIG. 15, the air deflector may include, or may be configured to receive, a magnet having a first ridge 35 and a second ridge 37. In various implementations, the magnet coupled within the first magnet retainer may be the same as the magnet coupled within the second magnet retainer. In implementations of magnets having ridges, the ridges may correspond to the first ledge 34 and the second ledge 36 of the first magnet retainer. In such implementations, the ridges may contact the ledges and interaction between the ridges and the ledges may prevent the magnet from being removed from the first magnet retainer through the area between the first ledge and the second ledge.

Figure 16:
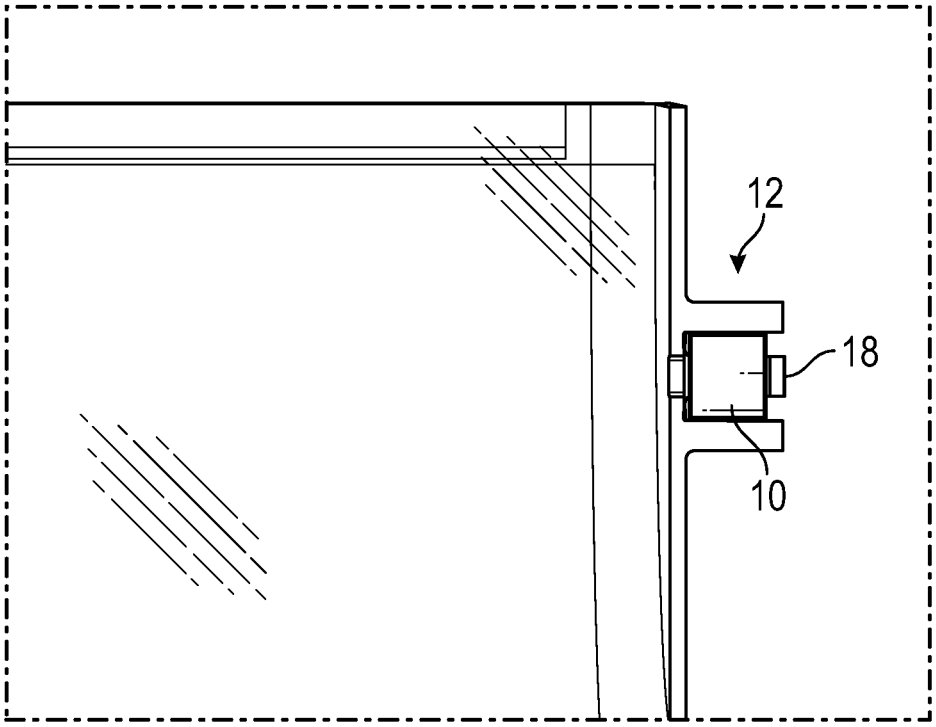
FIG. 16 is a bottom view of an implementation of a magnet retainer.
Figure 17:
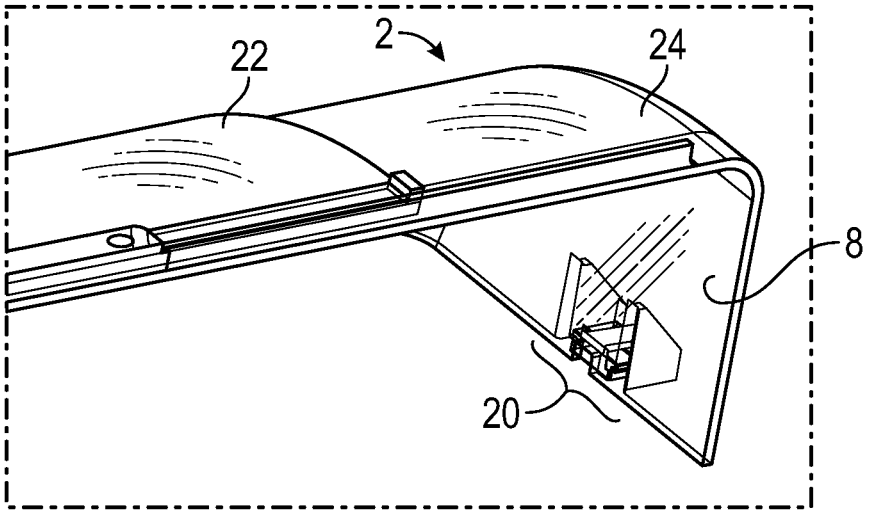
FIG. 17 is an inside see-through view of an implementation of an air deflector.

Referring to FIG. 16, a bottom view of an implementation of a magnet retainer is illustrated. In this figure, the end of the retainer tab extending over the side of the magnet opposite the side of the magnet facing the first sidewall is illustrated. In FIG. 17, an inside and transparent view of a magnet retainer 20 coupled to a sidewall 8 of the air deflector 2 is illustrated.

In various implementations, the surface of the magnet configured to contact the vent grille may be configured to have a double sided adhesive coupled thereto. In implementations where the vent grille is not attracted to the magnet (such as implementations of, by non-limiting example, an aluminum, wooden, or plastic vent grille), a double sided adhesive may be coupled to a bottom of each magnet. In such implementations, the double sided adhesive may be configured to secure the air deflector to the vent grille. In various implementations, the air deflector may be included in a kit which may include the air deflector, two magnets, and two pieces of double sided adhesive configured to directly couple to each of the magnets. In such implementations the air deflector kit may be configured to securely attach the air deflector to any type of vent grille. In other implementations, the kit may include more than or fewer than two magnets and/or two pieces of double sided adhesive.

The implementations of air deflectors disclosed herein may be securely attached to a vent grille due to the magnetic force between the magnets attached to the air deflector and the vent grille. More specifically, in the implementations having the magnet lie flat within the magnet retainer, or having the largest surface of the magnet oriented parallel to the surface the air deflector is to be coupled to, the air deflector may be secured to the vent grille with increased strength due to the increased surface area of the magnet configured to contact the vent grille as compared to implementations where the largest planar surface of the magnet is perpendicular to the surface the air deflector is to be coupled to. In various implementations disclosed herein, the air deflectors may be configured to securely attach to a vent grille located on a floor, a wall, or a ceiling.

In places where the description above refers to particular implementations of air deflectors and implementing components, sub-components, methods and sub-methods, it should be readily apparent that a number of modifications may be made without departing from the spirit thereof and that these implementations, implementing components, sub-components, methods and sub-methods may be applied to other air deflectors.

What is claimed is:

1. An air deflector comprising:

a curved section coupled between a first sidewall and a second sidewall;

a first magnet retainer extending from the first sidewall, the first magnet retainer comprising:

a first retainer wall;

a second retainer wall; and a retainer tab extending from the first sidewall and positioned between the first retainer wall and the second retainer wall;

a first magnet positioned between the first retainer wall and the second retainer wall, the first magnet comprising a largest planar surface and an exposed surface opposite the largest planar surface;

a second magnet retainer extending from the second sidewall; and a second magnet coupled within the second magnet retainer;

wherein the first retainer wall and the second retainer wall each comprise a ledge directly coupled to the first magnet;

wherein the exposed surface is configured to form a magnetic bond with and face an external surface; and wherein the first magnet is coupled between the retainer tab and each ledge of the first retainer wall and the second retainer wall.

2. The air deflector of claim 1, wherein the largest planar surface of the first magnet is perpendicular to a largest planar surface of the first sidewall and second sidewall.

3. The air deflector of claim 1, wherein the first magnet and second magnet are neodymium magnets.

4. The air deflector of claim 1, further comprising a notch located in the first sidewall and below a portion of the first sidewall from which the retainer tab extends.

5. The air deflector of claim 1, wherein the first retainer wall and the second retainer wall comprise a chamfer.

6. The air deflector of claim 1, wherein an end of the retainer tab is coupled over a first side of the first magnet opposite a second side of the first magnet facing the first sidewall.

7. The air deflector of claim 1, wherein the first magnet retainer is configured to expose the first magnet between each ledge of the first retainer wall and the second retainer wall.

8. The air deflector of claim 1, wherein the first magnet comprises a first ridge and a second ridge.

9. The air deflector of claim 1, wherein the first magnet is configured to contact the vent grille.

10. An air deflector comprising:

a first portion comprising a sidewall;

a first magnet retainer coupled to the sidewall of the first portion, the first magnet retainer comprising:

a first retainer wall, the first retainer wall comprising a first ledge securing a magnet;

a second retainer wall, the second retainer wall comprising a second ledge securing the magnet; and a retainer tab extending from the sidewall of the first portion and positioned between the first retainer wall and the second retainer wall;

a second portion comprising a sidewall and a plurality of guides configured to slidably couple the first portion to the second portion; and a second magnet retainer coupled to the sidewall of the second portion, wherein the second magnet retainer is structurally the same as the first magnet retainer;

wherein the first magnet retainer retains the magnet between the retainer tab and the first ledge and second ledge;

wherein the magnet comprises a largest planar surface and an exposed surface opposite the largest planar surface; and wherein the exposed surface is configured to contact a vent grille.

11. The air deflector of claim 10, wherein the first magnet retainer retains the magnet in a position where the largest planar surface of the magnet is perpendicular to a largest planar surface of the sidewall of the first portion.

12. The air deflector of claim 10, wherein the plurality of guides comprises a first guide coupled to a first side of a curved portion of the second portion and extending substantially across a length of the first side of the curved portion.

13. The air deflector of claim 12, wherein the plurality of guides comprises a second guide coupled to a second side of the curved portion of the second portion, the second side opposite the first side, and a third guide coupled to the second side of the curved portion of the second portion.

14. An air deflector comprising:

a first portion comprising a sidewall;

a first magnet retainer coupled to the sidewall of the first portion, the first magnet retainer comprising:

a first retainer wall, the first retainer wall comprising a first ledge configured to secure a magnet;

a second retainer wall, the second retainer wall comprising a second ledge configured to secure the magnet; and a retainer tab extending from the sidewall of the first portion and positioned between the first retainer wall and the second retainer wall;

a second portion comprising a sidewall; and a second magnet retainer coupled to the sidewall of the second portion, wherein the second magnet retainer is structurally the same as the first magnet retainer;

wherein the first portion is slidably coupled to the second portion through a plurality of guides comprised in the second portion;

wherein the first portion comprises a stop tab configured to prevent the first portion from separating from the second portion;

wherein the first magnet retainer is configured to retain a magnet between the retainer tab and the first ledge and second ledge;

wherein the first magnet retainer is configured to secure a magnet in an orientation having a largest planar surface opposite an exposed surface, the exposed surface configured to contact a vent grille and secure the air deflector to the vent grille.

15. The air deflector of claim 14, wherein the first retainer wall and the second retainer wall each comprise a chamfer.

16. The air deflector of claim 14, wherein an end of the retainer tab is configured to couple over a side of the magnet opposite the side of the magnet facing the sidewall of the first portion.

17. The air deflector of claim 14, wherein the first magnet retainer is configured to retain the magnet between the first ledge and the second ledge.

18. The air deflector of claim 14, wherein the stop tab is configured to contact a guide of the plurality of guides.

19. The air deflector of claim 14, wherein the stop tab is fixedly and non-removably attached to the first portion.

* * * * *